United States Patent [19]

Di Tullio

[11] Patent Number: 4,718,878

[45] Date of Patent: Jan. 12, 1988

[54] FRONT-OPENING BRASSIERE WITH RACER STYLE BACK

[75] Inventor: Flavia Di Tullio, New York, N.Y.

[73] Assignee: Bali Company, Winston-Salem, N.C.

[21] Appl. No.: 929,491

[22] Filed: Nov. 12, 1986

[51] Int. Cl.[4] ..... A41C 3/02

[52] U.S. Cl. ..... 450/58; 450/70

[58] Field of Search ..... 128/482, 509, 510, 511, 128/512, 441; 450/58, 85, 86, 87, 88, 17, 70

[56] References Cited

U.S. PATENT DOCUMENTS

| | | | |
|---|---|---|---|
| 911,204 | 2/1909 | Busby | 450/86 |
| 2,715,225 | 8/1955 | Gould | 128/482 |
| 2,882,905 | 4/1959 | Barg | 450/58 |
| 2,926,668 | 3/1960 | Schaumer | 128/482 |
| 2,926,669 | 3/1960 | Strauss | 128/510 |
| 2,954,031 | 9/1960 | Froehuck | 128/482 |
| 3,071,140 | 1/1963 | Adler | 128/510 |
| 4,449,533 | 5/1984 | Di Tullio | 450/70 |

*Primary Examiner*—Louis K. Rimrodt

*Attorney, Agent, or Firm*—Charles Y. Lackey; William S. Burden

[57] ABSTRACT

A racer back style front-opening brassiere having front sections adapted to be releasably secured together and a pair of back band assemblies secured to each other and to the front sections and having upwardly projection portions secured to shoulder straps in a crossed manner. The front sections are releasably secured together by discrete, spaced, and first and second closure means.

3 Claims, 8 Drawing Figures

FRONT-OPENING BRASSIERE WITH RACER STYLE BACK

The present invention relates to a brassiere construction and has particular application to a racer back style, front-opening brassiere. More specifically, the invention relates to a bra wherein new and novel features of construction are employed to provide more natural support and greater comfort to the wearer.

One of the primary objects of the invention is to provide a bra so formed and constructed as to give the desired support to the breasts without binding discomfort.

Another object of the invention is the provision of a bra which will accomodate the movements of the wearer without pulling, binding, and riding up on the back.

Still another object of the invention is the provision of a bra having separate and distinct closures for the bra front sections for positioning the cups in the desired spaced relationship to provide firm and more comfortable support while preventing lateral spread and undesirable expansion.

Those and other objects and advantages of the invention will become apparent when considered in connection with the accompanying drawings.

BRIEF DESCRIPTION OF A PREFERRED EMBODIMENT

Figure 1:
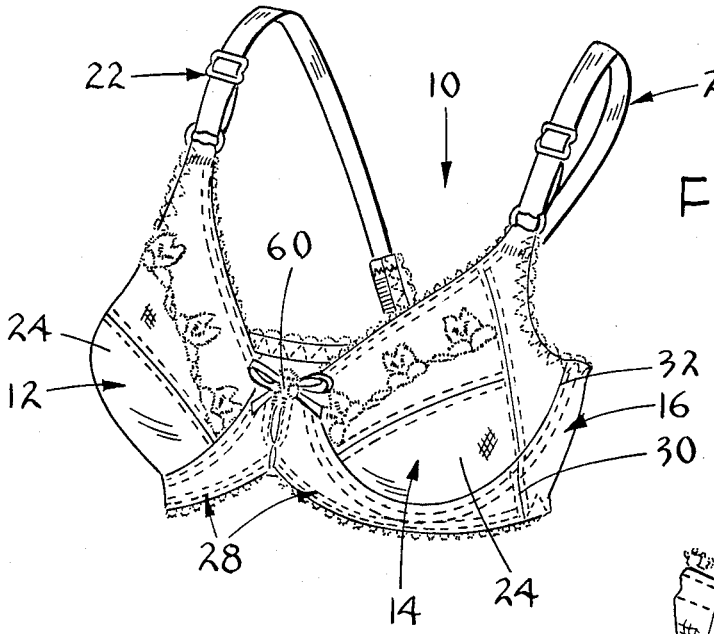
FIG. 1 is a front perspective view of a brassiere made in accordance with the present invention.
Figure 3:
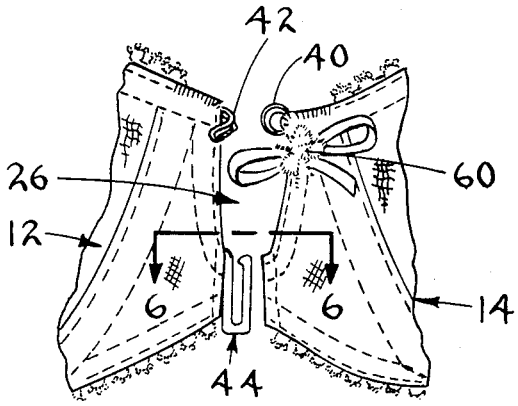
FIG. 3 is an enlarged fragmentary view of the front of the brassiere with the front closure assembly unhooked.
Figure 2:
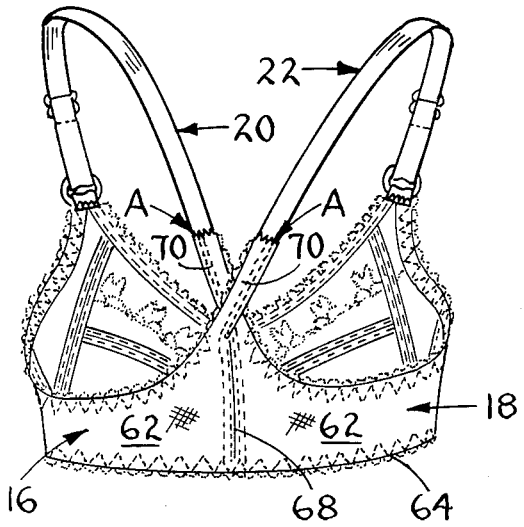
FIG. 2 is a rear perspective view of the brassiere of FIG. 1.

Referring to the drawing, the brassiere 10 includes a pair of front sections 12, 14 adapted to be releasably coupled together, a pair of back band assemblies 16, 18 which preferably are of stretch fabric, and adjustable shoulder strap assemblies 20, 22. Each of the front sections 12 and 14 includes a cup portion 24 which may be of various constructions and fabrics formed to impart the requisite shape to the cups. The cups may be provided with underwire if so desired. A coupling assembly 26 is provided for releasably securing together the pair of front sections 12, 14.

Each of the front sections 12, 14 includes a band 28 which extends from a position intermediate the cups 24, 24, along the lower marginal edges of an adjacent cup, and to a back band assembly 16 or 18, as shown. The cups are sewn to the bands 28 in a suitable manner as is customary. Also, the outermost portions of the cups 24, 24 and bands 28, 28 are sewn to the respective back band assembly along lines 30 and 32.

Figure 4:
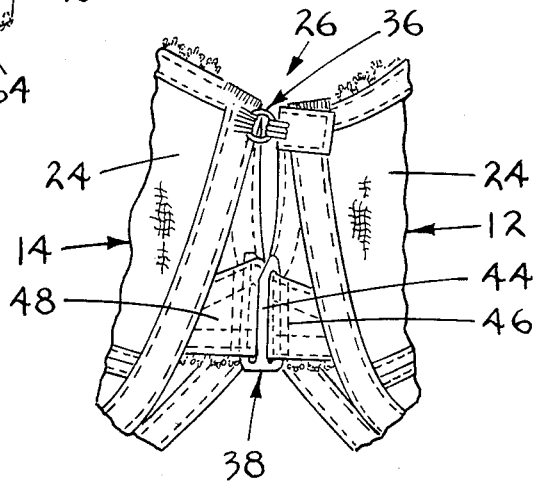
FIG. 4 is an enlarged fragmentary view taken from the rear of the brassiere and showing the closure assembly hooked.
Figure 5:
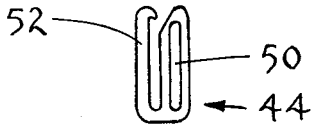
FIG. 5 is an enlarged view of the hook plate forming a portion of the closure assembly.
Figure 6:
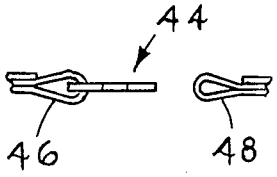
FIG. 6 is a sectional view taken along line 6—6 of FIG. 3.

The adjacent inner portions of the pair of front sections 12, 14 are releasably coupled together by assembly 26. In the embodiment illustrated, the connecting assembly 26 includes a coupling means 36 located at the uppermost adjacent portions of the front sections 12, 14 and a coupling means 38 located adjacent the lowermost adjacent portions of the sectons 12, 14. The upper coupling means 36 includes a loop or ring element 40 secured to one of the sections 12, 14 and a hook element 42 secured to the other of the pair of front sections 12, 14. The coupling means 36 thus serves to limit separation between the uppermost adjacent portions of the cups. A bow 60 or similar decorative element is attached to section 14 and overlies the hook 42 and loop 40 when they are coupled together. The lower coupling means 38 includes a hook-forming plate 44 and securing loops 46, 48 adjacent the bottom edges of the respective sections 12, 14. The securing loops 46, 48 in the embodiment illustrated are formed by folding and sewing terminal end portions of the fabric defining the bands 28, 28, as shown by FIGS. 4 and 6. The plate 44 is attached to the front section 12 since the loop 46 passes through opening 50 in the plate. The hook portion 52 of the plate is adapted to be releasably inserted through the loop 48. Alternatively, the loops 46, 48 may be separate, discrete elements secured to the front sections 12, 14 for cooperating with the plate 44.

The terminal portions 62, 62 of the bands 16, 18 cooperate to define a racer style back. Each terminal end 62 includes an elongated portion 70 which extends upwardly a substantial distance above the lower marginal edges 64 of the back bands and towards the center of the back of a wearer. The terminal ends 62, 62 are secured together by a generally vertical seam 68 which extends for a predetermined length. The portions 70, 70 are not sewn together, but each has a shoulder strap assembly 20 or 22 sewn thereto as indicated at A on FIGS. 7, 8. The projecting portions 70, 70 are crossed as shown by FIGS. 7 and 8, and the bands 16, 18 and the straps of the assemblies 20, 22 are of elastic construction.

The racer back crossed construction provides for a diagonal cross pull on the strap assemblies 20, 22 and the back bands 16, 18 when worn, thus dispersing tension and eliminating direct stress on one upon movement of the wearer.

Figure 7:
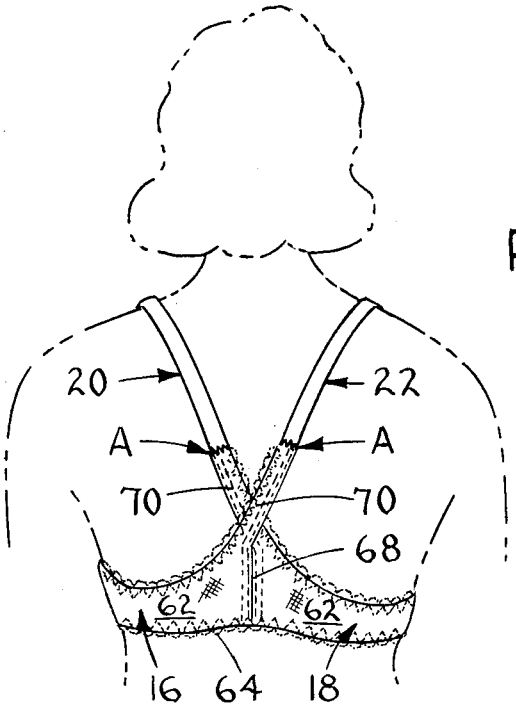
FIG. 7 is a rear elevational view showing the crossed racer style back of the bra on a body at rest.
Figure 8:
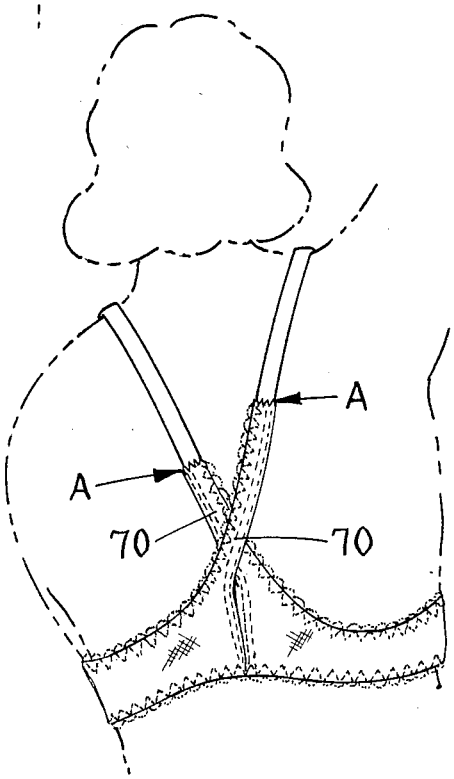
FIG. 8 is a back view of the bra as worn shown with shoulder movement to illustrate compensating stretch.

Referring to FIGS. 7 and 8, FIG. 7 shows the racer back bra at rest on a wearer. Note that the corresponding junctures A of the portions 70, 70 with the shoulder straps are aligned opposite each other in FIG. 7, and upon shoulder movement of the wearer, FIG. 8 illustrates the compensating stretch of the strap from back opposite the shoulder movement.

What is claimed is:

1. A brassiere construction including a pair of front sections, each front section including a cup and a front band secured to the cup, each said front band including a first portion extending vertically between the cups of said first sections, and a second portion extending along marginal lower edges of an adjacent cup, means for releasably coupling said first portions of said front bands for securing the brassiere in encircling relation upon a wearer, said coupling means including vertically spaced first and second discreet pairs of hook and loop elements secured to said first portions of said front bands adjacent upper and lower marginal edge portions of said first portions, a pair of back band assemblies, said back band assemblies including first portions connected to said second portions of said front bands, each said back band assembly further including a second portion having a first section and an elongated second section, means securing together said first sections, said second sections extending generally vertically upwardly substantially perpendicular to lower marginal edges of said first section, and centrally of the back of a wearer to define a racer style, said second sections being independently displaceable relative to each other and said second sections, and disposed in crossed fashion, and a pair of adjustable strap assemblies secured to said front sections and to said second sections.

2. A construction as recited in claim 1 wherein one of said loop elements is integral with said first portion of said front band of one of said pair of front sections.

3. A construction as recited in claim 1 wherein said back band assemblies second sections are of stretch fabric.

* * * * *